United States Patent [19]

Tison et al.

[11] Patent Number: 4,808,281

[45] Date of Patent: Feb. 28, 1989

[54] PHOSPHATE COATING COMPLEX METAL SURFACES

[75] Inventors: Richard P. Tison, Pontiac; Su-Chee S. Wang, Sterling Heights; Dexter D. Snyder, Birmingham, all of Mich.

[73] Assignee: General Motors Corporation, Detroit, Mich.

[21] Appl. No.: 212,352

[22] Filed: Jun. 27, 1988

[51] Int. Cl.[4] ..... C25D 11/00

[52] U.S. Cl. ..... 204/56.1

[58] Field of Search ..... 204/90, 56.1

[56] References Cited

U.S. PATENT DOCUMENTS

| | | | |
|---|---|---|---|
| 870,937 | 11/1907 | Coslett . | |
| 2,173,103 | 9/1939 | Fraser | 204/90 |
| 2,912,372 | 11/1959 | Stoddard | 204/151 |
| 2,927,068 | 3/1960 | Marsh et al. | 204/147 |
| 3,005,763 | 10/1961 | Kollsman | 204/180 |
| 3,006,828 | 10/1961 | Gaysowski | 204/151 |
| 3,074,863 | 1/1963 | Jasionowski | 204/151 |
| 3,262,867 | 7/1966 | Callahan | 204/38 |
| 3,409,525 | 11/1968 | Taylor, Jr. et al. | 204/147 |
| 3,479,260 | 11/1969 | Rauch, Jr. et al. | 204/56 |
| 4,004,994 | 1/1977 | Andrus | 204/149 |
| 4,248,684 | 2/1981 | Doniat | 204/149 |
| 4,310,406 | 1/1982 | Smith et al. | 204/275 |
| 4,522,892 | 6/1985 | Shindow et al. | 428/628 |
| 4,714,529 | 12/1987 | Wang et al. | 204/56.1 |

OTHER PUBLICATIONS

J. R. Parris, *Electrical Conductance of Particles of Ion--Exchange Resin,* J. Chemical Soc., 1962, pp. 612–617.

M. C. Sauer, Jr., P. F. Southwick, K. S. Spiegler and M. R. J. Wyllie, *Electrical Conductance of Porous Plugs,* Indus. & Engring, Chem., vol. 47, No. 10, Act. 1955, pp. 2187–2193.

G. S. Solt, *Electrodialysis,* Membrane Separation Processes, P. Meares, Ed. Elsevier Scientific Publishing Co., N.Y. 1976, pp. 258–259.

*Pitting and Deposits with an Organic Fluid by Electrolysis and by Electrolysis and by Fluid Flow,* by T. R. Eck, D. W. Mahaffey, and J. H. Olsen, J. Electrochem. Soc., Feb. 1972, pp. 155–160.

*Effects of Additives on the Friction of Steel on Steel,* by Fred G. Rounds ASLE Transactions 7, 11–23 (1964).

*Some Factors Affecting the Decomposition of Three Commercial Zinc Organodithiophosphates,* by Fred G. Rounds, ASLE Transactions, vol. 18, 2, pp. 79–89, 1973.

*Additive Intractions and Their Effect on the Performance of a Zinc Dialkyl Dithiophosphate,* by Fred Rounds, ASLE Transactions, vol. 21, pp. 91–101, 1976.

*General Motors Engineering Standards,* GM 4277–M, Anti–Friction Finish–*Phosphate Type,* p. 43.101, Nov. 1979, Dec. 1984, pp. 43.201–43.203.

*Metals Handbook, Nonmetallic Coating Processes,* pp. 531–547.

"*Electrophysical and Electrochemical Phenomena in Friction Cutting, and Lubrication*", by S. N. Postnikov, pp. 93, 111–113, Dec. 1969.

USSN 178,032 (Art Unit 112)–"Electrolytic Demetallization of Dilute Solutions Using Ion Exchange Resins" Filed Apr. 5, 1988 as a CIP of USSN 028,387 Filed Mar. 20, 1987.

*Primary Examiner*—R. L. Andrews

*Attorney, Agent, or Firm*—Lawrence B. Plant

[57] ABSTRACT

Anodic formation of amorphous iron phosphate films in a dialkyl hydrogen phosphate electrolytic medium containing hydrogen-rich cation exchange resin particles having a free moisture content between about 9% and about 33% by weight.

6 Claims, No Drawings

PHOSPHATE COATING COMPLEX METAL SURFACES

This invention relates to anodically forming substantially amorphous friction and wear reducing iron phosphate coatings on complex iron surfaces using dialkyl hydrogen phosphate electrolytic reaction mediums.

BACKGROUND OF THE INVENTION

Oil-based lubricants (e.g., mineral oils) commonly include additives for reducing friction between, and wear of, iron-based parts (e.g., steel, cast iron, etc.). Such additives slowly chemically react with the metal surfaces to form an iron phosphate film thereon which provides the lower friction and wear characteristics. Wang et al U.S. Pat. No. 4,714,529, discloses and claims anodizing iron-based parts in an electrolytic medium comprising an oil-based lubricant and a dialkyl hydrogen phosphate, such as dilauryl hydrogen phosphate or mixed-dialkyl acid orthophosphate, (hereafter DHP) to more rapidly electrochemically form thicker more uniform iron phosphate films. Wang et al is intended to be incorporated herein by reference. According to Wang et al, the anodic iron-based workpiece is closely spaced (i.e., ca. 0.15 mm) from a cathodic counterelectrode in the DHP-medium and current passed therebetween to electrochemically form the desired iron phosphate film. In Wang et al, it is believed that: the DHP dissociates in the lubricant to form hydrogen cations and a corresponding organic anion; as current passes, iron dissolves from the workpiece surface (i.e., as ferrous ions) and immediately reacts with the organic anions to form the amorphous iron phosphate coating [i.e., $Fe_3(PO_4)_2$]; and the hydrogen ions migrate to the cathode and form $H_2$ thereat.

While the Wang et al process is effective to produce friction and wear reducing iron phosphate films, the inherently high electrical resistivity (i.e., ca. $>10^9$ ohm-cm) of the DHP-oil medium limits use of the process to electrodes which are separated by no more than about 200 micrometers at all locations thereof and hence requires conforming electrodes. Such a restriction limits the practical application of the Wang et al process particularly with respect to the application thereof to forming films on complex-shaped surfaces (e.g., camshaft lobes) having some portions thereof proximate (i.e., within about 200 μm) and other portions more remote (i.e., significantly greater than 200 μm) from the cathode.

It is an object of the present invention to so increase the electrical conductance of a dialkyl hydrogen phosphate anodizing medium as to substantially improve its ability to form amorphous iron phosphate friction and wear reducing films on complex iron workpiece surfaces which have some portions proximate the cathode and other portions remote therefrom and thereby extend the usefulness of the process without the need for conforming electrodes. This and other objects and advantages of the present invention will be more readily apparent from the detailed description thereof which is given hereafter.

BRIEF DESCRIPTION OF THE INVENTION

The present invention principally comprehends a method for rapidly electrochemically forming an amorphous friction and wear reducing iron phosphate film over a complex-shaped surface of an iron-based workpiece (i.e., at least 50% Fe) comprising the steps of: immersing the workpiece and a counterelectrode in an electrolytic medium comprising a dialkyl hydrogen phosphate (DHP) pervaded with hydrogen-rich cation exchange resin particles having a free moisture content between about 9% and about 34% by weight; and passing electrical current through the workpiece, medium and counterelectrode so as to anodize said surface, and form said film thereon. The resin particles (e.g., granules, spheres, beads, etc.) can vary in size from about 40 micrometers to about 1.2 millimeters in diameter (i.e., 400–16 mesh) and have a prescribed moisture content to minimize competing/interfering anode reactions. The term cation exchange resin is used herein in its accepted sense, i.e., a solid organic material having a matrix with fixed ions (i.e., chemically bound functional groups) and oppositely charged mobile counterions which can be exchanged reversibly with ions of like charge from a surrounding liquid environment. The mobile counterions within the resin provide ionic, electrical conductivity through the resin which is largely fixed and substantially independent of the conductivity of the surrounding liquid environment. It is this conductance phenomenon, rather than the ion exchange capability, that contributes to the success of the present invention. When an ion exchange material of high hydrogen counterion capacity (and correspondingly high electrical conductance) is added to the poorly conductive DHP or DHP-oil mix, the conductivity of the system is greatly increased as the hydrogen ions formed at the anodic workpiece surface readily flow through the resin beads to the cathode where they combine and form $H_2$. The richer the resin is in hydrogen ions the more conductive it is. Hence it is preferred to use ion exchange resin particles which are virtually saturated with mobile hydrogen ions. Such is typical of strongly acidic resin beads. The expression "strongly acidic" cation exchange resin is used in the sense well known to those skilled in the ion exchange art and generally relates to those phenolic condensation or addition products containing functional groups derived from strong acids. Strongly acidic, gel-type, cation exchange resins which have a matrix of styrene and divinyl benzene with sulfonic acid functional groups are considered to be particularly useful with the present invention. Two such strongly acidic resins are Amberlyte IR-120 and Dowex HGR-W2, which both contain sulfonate functional groups. Amberlyte IR-120 resin is sold by the Rohm and Haas Company and is characterized as a strongly acidic, sulfonated polystyrene cation exchange resin having a medium porosity, $RSO_3$—$H^+$, and the following properties:

| | |
|---|---|
| Apparent Density (average) | 0.77 g/mL |
| Mesh Size (wet) | 20–50 mesh |
| Void Volume | 35–40% |
| Degree of Regeneration | 98% min. |
| Moisture Holding Capacity | 52% |
| Total Exchange Capacity | |
| Volume | 1.75 meq./mL min. |
| Weight (dry) | 5.0 meq./g min. |

Dowex HGR-W2 resin is sold by the Dow Chemical Company and is said to have been made from the sulfonation of styrene-divinyl benzene copolymer beads and has the following properties:

| Form | $Na^+$ Form | $H^+$ |
|---|---|---|
| Specific gravity | 1.31 | 1.22 |
| Standard Screen Size (wet) | | |
| on 16 mesh, max | 2% | 2% |
| through 40 mesh, max | 1% | 1% |
| Screen Index Range | 300–450 | 300–450 |
| Water Retention Capacity | 40–43% | 47–50% |
| Minimum Capacity | | |
| meq./g dry resin | 4.35 | 4.75 |
| meq./mL wet resin | 2.2 | 2.0 |
| kg/cu. ft. as calcium carbonate | 48.0 | 43.6 |

To insure hydrogen ion saturation, the as-purchased resin particles may be soaked in acid for a sufficient period of time to replenish any hydrogen ion sites therein.

The free moisture content of the cation exchange resin has been found to be particularly significant to the effectiveness of the process in that: too little moisture (i.e., below about 9% by weight) results in high electrical resistance and the slow formation of iron phosphate across the substrate surface; and too much moisture (i.e., greater than about 34% by weight) results in no iron phosphate being formed. A bead moisture content of about 9% to about 18% by weight is preferred for achieving a substantially uniform iron phosphate coating at an acceptable rate over all surfaces of a complex shaped part without the need for conforming electrodes.

The DHP mediums may vary from as low as about 2.5% DHP in oil to 100% DHP. DHP-mineral oil mixes of about 50% to about 85% by weight DHP are preferred (most preferably about 65%–75%) as they have been found: to be more stable against deterioration than 100% DHP mediums; and produce the thickest, most uniform films in a reasonable period of time. Stability-wise, it has been observed that the electrochemical film-forming mechanism is very sensitive to the moisture content of the DHP-containing medium and that as a result the inherent hygroscopicity of 100% DHP results in mediums which are short-lived (i.e., a few days) owing to water take-up from the ambient. The DHP-oil mixes: do not absorb moisture so quickly and accordingly have a much longer useful life. DHP-oil mixes as low as 2.5% have been used. However, the conductivity of such dilute DHP mixtures is so poor that the iron-phosphate forms very slowly and in an array of small patches distributed over the workpiece surface. Eventually, but only after prolonged current passage, the patches merge into a continuous film. Above about 85% DHP, the films also form quite slowly possibly due to a lesser dissociation of the DHP than occurs in oil.

TESTS

A plastic electrochemical cell was fabricated for evaluating the electrochemically induced iron phosphate formation over a wide range of anode/cathode separations. Similar to a Hull cell, an essentially triangular cell was employed so as to position a mild steel anode panel (i.e., 15×32 mm) at a wide angle (i.e., about 39°) to a mild steel cathode panel (i.e., 15×26 mm). This arrangement resulted in electrode separations (gap) which varied over two orders of magnitude, i.e., from about 0.25 mm at the closest point to about 25 mm at the furthest point. Tests were conducted: for various durations (i.e., from 2 min. to 5 hours); at various current and voltage levels; with mediums comprising 100% DHP, 50% DHP in oil and 2.5% DHP in oil; and with resin moisture levels varying from essentially saturated to as low as 9% by weight free water. The lubricant was an additive-free, mineral oil available commercially from CITGO Petroleum Corp. as its product Sentry 69. The DHP used was DuPont's Ortholeum 162 (i.e., mixed alkyl hydrogen phosphate). The resin beads used were Amberlyte-120.

The as-purchased Amberlyte beads were washed repeatedly in distilled water until the amber coloration was essentially gone. In one preliminary series of tests to assess the affects of moisture content, the beads were dried by: (1) blotting on filter paper; (2) air dried at room temperature and humidity overnight; (3) dried with a $CaSO_4$ desiccant overnight; and, (4) oven dried at 100° C. for 2 hours. In a subsequent more sophisticated series of tests designed to more accurately quantify the moisture content, the resin was essentially dehydrated by heating two hours in an oven at 100° C. followed by placing separate measured portions thereof in sealed containers with controlled amounts of water until all the free water in each container was taken up by the beads. Tests were conducted on electrolytic DHP mediums both with and without the resin beads present under both constant current and constant voltage conditions.

OBSERVATIONS

The tests showed that iron phosphate coatings were obtainable over a much larger area of the anode panels when the ion exchange beads were present in the DHP medium than when no beads were present. In this regard, without the beads, iron phosphate formed only on the edge of the anode workpiece closest to the cathode (i.e., about 0.25 mm gap). In stark contrast with the beads present the iron phosphate formed across essentially the entire test panel including areas which were as much as 25 mm from the cathode. Effective iron phosphate film formation occurred at average anode current densities varying from about 0.8 milliamps per square centimeter to between 1.6 $ma/cm^2$ and 3.2 $ma/cm^2$ depending on the DHP concentration in the medium. In this later regard, current flow generally increased with increasing DHP concentration in the oil.

Using 100% DHP (i.e., no oil), the desired blue/-brown iron-phosphate film adequately formed when the DHP was fresh. However, after being exposed to the ambient for several days, it lost its ability to produce the film whether ion-exchange beads were present or not. This behavior is attributed to moisture uptake by the DHP which is thought to allow an alternate and competitive water oxidation reaction to occur at the anode rather than the desired anodic film-forming reactions.

As moisture sensitivity of the medium was thought to be a problem, tests were conducted with controlled amounts of water in the beads as well as with the DHP-oil mixtures believed to be less hygroscopic than pure DHP and therefore more stable over a longer period of time. These tests showed that electrical resistance of the medium was indeed moisture sensitive and varied in inverse proportion. It was observed from these tests that iron phosphate coatings were obtained with increasing ease as the moisture content of the resin beads increased up to about 34% by weight free water. Above about 34% water no visible coating could be observed and gassing, rather than coating, was observed at the anode. About 9% bead moisture was necessary to obtain adequate conductance.

Short duration tests (i.e., up to about 10 min.) produced a discontinuous coating characterized by an array of circular patches of the iron phosphate distributed over the test panel. Longer duration tests (e.g., 3 hours) resulted in a continuous film whose thickness varied from thickest where the anode was nearest the cathode to thinnest where the anode was more remote from the cathode. Occasional stirring tended to promote the formation of a continuous coating but at the expense of some reduced throwing power resulting in no film formation on areas of the anode most remote from the cathode. Deposition rates of 21, 14, and 8 nm/h were obtained across one test panel at positions where anode-cathode electrode gaps were 4, 10, and 19 mm respectively.

With the 2.5% DHP-oil mix, coatings were obtained which were visually similar to the coatings formed from pure DHP and the 50% DHP-oil mix but were more difficult to obtain. With oven-dried resin beads (i.e., dehydrated) the coatings formed very slowly, apparently due to the high electrical resistivity of the medium resulting from the low concentrations of both the DHP and the moisture. The air-dried and $CaSO_4$ desiccated beads allowed higher currents, but such higher currents provided an undesirable waxy, complex film composition which contained sulfur and carbon along with the oxygen, phosphorous and iron. Apparently these conditions—i.e., low DHP concentration, plus high moisture and current—allowed other competitive electrochemical reactions (e.g., DHP degradation or water oxidation) to dominate or co-exist with the iron phosphate formation reaction.

The following is a representative summary of some of the results observed in early testing.

TABLE

| MATERIAL | TEST CONDITIONS | RESULTS |
|---|---|---|
| 100% DHP | | |
| No beads (fresh) | 4 mA, 2 min, 108–130 V | blue/brown deposit on left 6 mm only |
| No beads (stirred 5 days) | 4 mA, 2 min, 56–53 V | no deposit observed |
| With beads, desiccated (fresh) | 4 mA, 2 min, 24–45 V | no deposit observed |
| With beads, untreated (fresh) | 4 mA, 2 min, 8–15 V | no deposit observed |
| 50% DHP - 50% OIL | | |
| No beads | 300 V, 3.0 h, 74–100 μA | deposit on left 0.5 mm only |
| With beads, desiccated | 4 mA, 2.5 h, 178–225 V | circular patches of deposit, 0.3 mm avg. dia., over entire panel |
| With beads, oven dried, intermittant stirring | 300 V, 1.0 h, 1.1–0.9 mA | speckled deposit, thin on right side |
| With beads, oven dried | 300 V, 3.8 h, 1.4–0.5 mA | circular patches of deposit, 0.4 mm avg. dia., over entire panel; analysis indicated Fe, P, O as $Fe_3(PO_4)_2$ and film thicknesses of 32, 55, and 80 nm at electrode gaps 19, 10, and 4 mm, respesctively |
| 2.5% DHP | | |
| No beads | 300 V, 5.0 h, 0.1–3.0 μA | deposit on left 1.0 mm only |
| With beads, oven dried | 300 V, 1.5 h, 22–4.0 μA | small circular patches of deposit, 0.06 mm avg. dia., on left 12 mm only |
| With beads, desiccated | 4 mA (unstable) 40 min, 80–200 V | waxy, grey/black deposit over entire panel; analysis indicated S, C, Fe, P, and O |

Further short-term test (i.e., 4 mA for 10 min) were performed in two series. One series held the DHP/oil ratio constant at 70% and varied bead moisture content from 0–38% (% of total bead weight existing as free water). Lower moisture contents (less than 9%) required higher voltage (higher electrical resistance) and produced only hollow circular patches of coating while higher bead moisture contets (greater than approximately 33%) produced very little deposit at all, especially at the largest electrode gaps (i.e., less "throw"). Thus about 9–33% is considered a practical range with about 9–18% moisture being preferred. The second series held bead moisture constant at 18% and varied the DHP/oil ratio from 50–100%. The lowest, 50% DHP content required high applied voltage (high electrical resistance) and formed only very small circular patches of deposit (approximately 0.18 mm diameter compared to approximately 0.36 mm diameter when formed at 75% DHP). Higher DHP (greater than approximately 85% DHP) produced only very light deposits, especially at the largest electrode gaps (less "throw"). Thus while about 50–100% DHP is an operative range, about 50% to 85% is a more practical range and about 65–75% DHP the preferred range. Long-term tests of 4 mA for 3 hours were also run with selected conditions, and deposits analyzed for 2 of them. Those long tests produced significantly more continuous films. Analysis of the samples showed that samples which was deposited within the ideal operating range (i.e., 70% DHP/18% bead $H_2O$) to be two to three times thicker and more uniform in thickness than samples which were deposited outside the ideal operating range but within the practical range, (i.e., 100% DHP, 18% water).

While the invention has been disclosed primarily in terms of certain specific examples thereof it is not intended to be limited thereto but only to the extent set forth hereafter in the claims which follow.

The embodiments of the invention in which an exclusive property or privilege is claimed are defined as follows:

1. In the method of forming a substantially amorphous, low friction, wear resistant iron phosphate coating on the surface of an iron-based substrate including the principle step of anodizing said surface in a liquid medium comprising dialkyl hydrogen phosphate, the improvement comprising enhancing the throwing power of said medium by substantially pervading said medium with hydrogen-rich cation exchange resin particles having a free moisture content between about 9% and 33% by weight.

2. In the method of forming a substantially amorphous, low friction, wear resistant iron phosphate coating on the surface of an iron-based substrate including the principle step of anodizing said surface opposite a cathode in a liquid medium comprising dialkyl hydrogen phosphate, the improvement comprising enhancing the throwing power of said medium sufficient to form said coating over a complex said surface having at least one portion proximate said cathode and another portion remote from said cathode by substantially pervading said medium with hydrogen-rich cation exchange resin particles having a free moisture content between about 9% and 33% by weight.

3. The method according to claim 2 wherein said dialkyl hydrogen phosphate is mixed with an oil-based lubricant.

4. The method according to claim 2 wherein the concentration of said dialkyl hydrogen phosphate in said lubricant is between about 50% and about 85% by weight.

5. The method of claim 4 wherein said dialkyl hydrogen phosphate is between about 65% and 75% by weight.

6. The method according to claim 3 wherein said dialkyl hydrogen phosphate is selected from the group consisting of dilauryl hydrogen phosphate and mixed dialkyl acid orthophosphate.

* * * * *